US011111829B2

(12) United States Patent
Gatti et al.

(10) Patent No.: US 11,111,829 B2
(45) Date of Patent: Sep. 7, 2021

(54) INTERNAL COMBUSTION ENGINE WITH IMPROVED LUBRICATION CIRCUIT

(71) Applicant: PIAGGIO & C. S.p.A., Pisa (IT)

(72) Inventors: Giuseppe Gatti, Pisa (IT); Adriano Magherini, Pisa (IT)

(73) Assignee: PIAGGIO & C. S.P.A., Pontedera (IT)

( * ) Notice: Subject to any disclaimer, the term of this patent is extended or adjusted under 35 U.S.C. 154(b) by 0 days.

(21) Appl. No.: 16/754,781

(22) PCT Filed: Oct. 15, 2018

(86) PCT No.: PCT/IB2018/057964
§ 371 (c)(1),
(2) Date: Apr. 9, 2020

(87) PCT Pub. No.: WO2019/077463
PCT Pub. Date: Apr. 25, 2019

(65) Prior Publication Data

US 2020/0300132 A1 Sep. 24, 2020

(30) Foreign Application Priority Data

Oct. 18, 2017 (IT) ..... 102017000117886

(51) Int. Cl.
*F01M 1/02* (2006.01)
*F01M 1/16* (2006.01)
*F01M 11/00* (2006.01)

(52) U.S. Cl.
CPC ..... *F01M 1/02* (2013.01); *F01M 1/16* (2013.01); *F01M 11/0004* (2013.01); *F01M 2001/0269* (2013.01)

(58) Field of Classification Search
CPC ..... F01M 1/02; F01M 1/16; F01M 11/0004; F01M 2001/0269
(Continued)

(56) References Cited

U.S. PATENT DOCUMENTS 4,519,348 A 5/1985 Hamilton
5,887,564 A 3/1999 Kawamoto
(Continued)

FOREIGN PATENT DOCUMENTS

DE 102013021557 A1 6/2015
DE 102013113611 A1 6/2015
(Continued)

OTHER PUBLICATIONS

International Search Report for corresponding application PCT/IB2018/057964 filed Oct. 15, 2018; dated Mar. 11, 2019.
(Continued)

*Primary Examiner* — Joseph J Dallo
*Assistant Examiner* — Yi-Kai Wang
(74) *Attorney, Agent, or Firm* — Cantor Colburn LLP

(57) ABSTRACT

An internal combustion engine including a crank chamber housing a crankshaft connected to moving parts able to supply torque to the crankshaft, a lubrication circuit, an oil sump for collecting the lubricating oil, the engine including a separating partition which separates the crank chamber from the oil sump, in which the lubrication circuit includes a first oil pump and a second oil pump, where the first oil pump is fluidically connected in aspiration to the crank chamber and in delivery to the oil sump, the second oil pump being fluidly connected in aspiration to the oil sump and in delivery to the crank chamber by means of the lubrication circuit, to re-introduce pressurised oil in the crank chamber and lubricate the moving parts.

12 Claims, 6 Drawing Sheets

(58) Field of Classification Search
USPC ..... 123/196 R
See application file for complete search history.

(56) References Cited

U.S. PATENT DOCUMENTS

| | | | | |
|---|---|---|---|---|
| 6,332,444 | B1 | 12/2001 | Narita | |
| 2004/0245050 | A1 | 12/2004 | Kawamoto | |
| 2015/0152757 | A1* | 6/2015 | Barber | F01M 5/001 123/304 |
| 2016/0061160 | A1* | 3/2016 | Fletcher | F04F 5/22 417/159 |
| 2019/0085739 | A1* | 3/2019 | Tanaka | F02F 7/006 |
| 2020/0049035 | A1* | 2/2020 | Feng | F01M 11/12 |

FOREIGN PATENT DOCUMENTS

| | | |
|---|---|---|
| FR | 503360 | 5/1917 |
| GB | 529500 | 11/1940 |

OTHER PUBLICATIONS

Written Opinion for corresponding application PCT/IB2018/057964 filed Oct. 15, 2018; dated Mar. 11, 2019.

* cited by examiner

INTERNAL COMBUSTION ENGINE WITH IMPROVED LUBRICATION CIRCUIT

TECHNICAL FIELD

The present disclosure relates to an internal combustion engine equipped with an improved lubrication circuit.

BACKGROUND

As is known, the lubrication circuit is an essential part for ensuring the proper functioning of an internal combustion engine.

In fact, the lack or insufficient lubrication of the moving parts of an internal combustion engine causes the seizing of the same, exponentially increases the wear and/or significantly decreases its duration and reliability.

The lubrication circuit essentially comprises an oil pump that sends the pressurised oil to all the fixed and moving parts which need to be constantly lubricated with a thin film of oil.

In wet casing systems the pump is usually placed in the oil sump or next to it. The oil sump communicates with the crank chamber and is arranged below it, so as to collect, by gravity, all the oil circulating inside the engine. Thanks to the pump, the oil is re-introduced into the engine.

This solution is not without disadvantages.

In fact, while from a constructive point of view it is quite simple, since the oil falls by gravity into the sump and from here is re-introduced by means of the oil pump, on the other the oil in the sump is highly stressed in thermal terms since it undergoes direct heating by irradiation due to the moving parts in the crank chamber.

In addition, said moving parts tend to modify the oil by increasing the presence of oil vapours, mixed with combustion gas, in the crank chamber. This aspect entails the need to use special oil vapour recovery devices of the centrifugal type, in order to effectively separate the oil from the gases, before re-introducing the latter in suction into the engine.

Lubricating oil is an essential element for the proper functioning of the engine and its heating causes its rapid deterioration and significantly decreases its lubricating power. This reduces the oil change time and also reduces the powertrain performance.

To solve these problems, for example, it is known of to increase the size of the oil sump so as to distance the oil as far as possible from the heat source constituted by the moving parts in the crank chamber. This solution, however, entails an increase in dimensions that is not always acceptable, especially in the motorcycle sector.

It is also known of, in order to limit the oil temperature increase, to add a heat exchange radiator specific to the lubricating oil. This solution, however, increases both the overall dimensions and the costs of the circuit; in the motorcycle sector moreover, there are even more restrictive aesthetic and dimensional aspects.

To solve these temperature problems the dry casing solution is also known of, in which the oil is collected in a tank completely separate from the crank chamber and often superposed therewith.

A pump is placed inside the dry casing which sends the oil into the lubrication circuit.

This solution, however, still has the disadvantage of dimensions and is often not applicable in the motorcycle sector where the available space is greatly reduced.

The need is therefore felt to resolve the drawbacks and limitations mentioned with reference to the prior art.

Such purpose is achieved by an internal combustion engine disclosed herein.

DESCRIPTION OF THE DRAWINGS

Further characteristics and advantages of the present disclosure will be more clearly comprehensible from the description given below of its preferred and non-limiting embodiments, wherein.

The elements or parts of elements common to the embodiments described below will be indicated using the same reference numerals.

DETAILED DESCRIPTION

Figure 1:
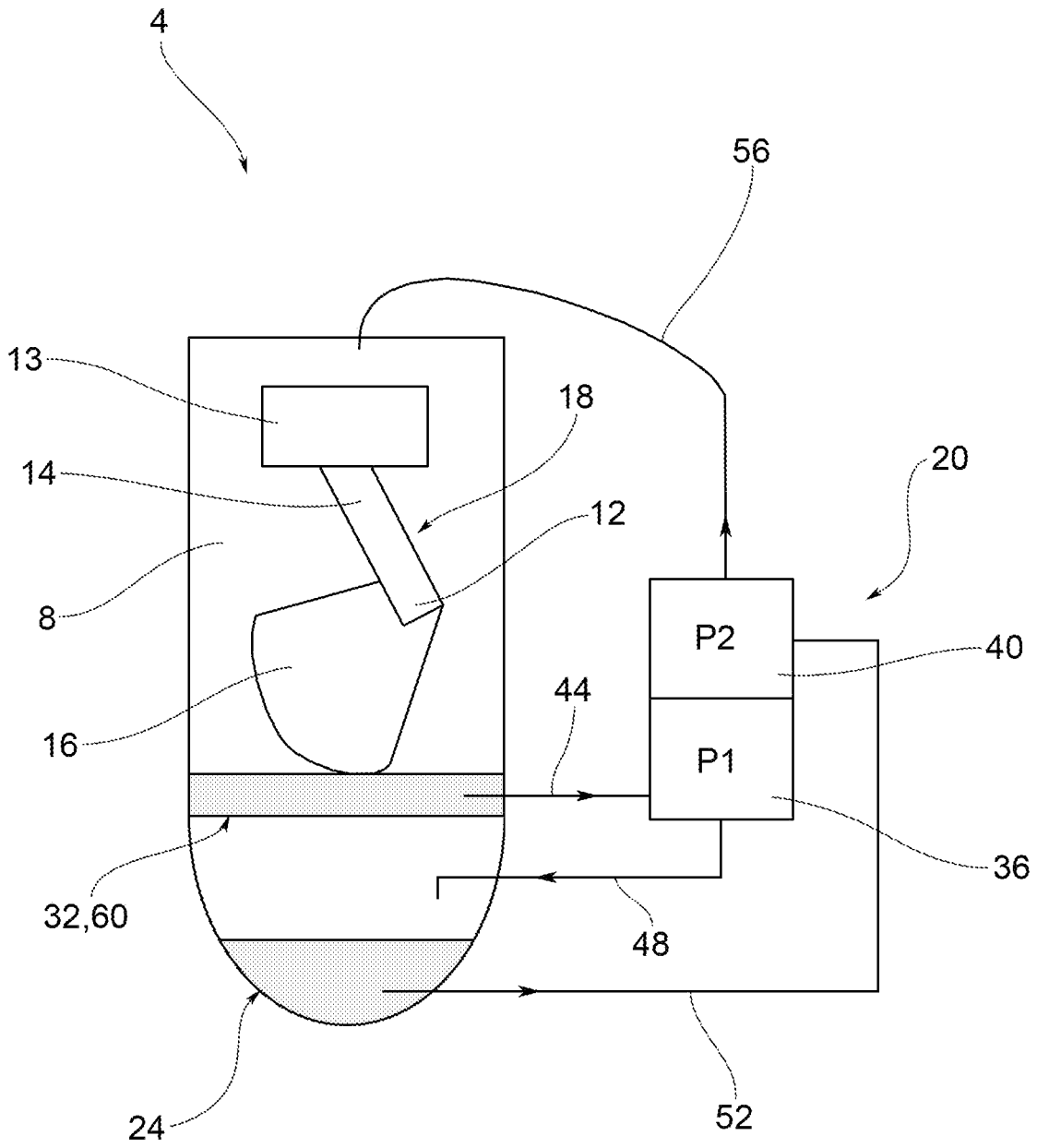
FIG. 1 shows a schematic view of an internal combustion engine provided with an improved lubrication circuit, according to one embodiment of the present disclosure.

With reference to the aforementioned figures, reference numeral 4 globally denotes a schematic, overall view of an internal combustion engine according to the present disclosure.

For the purposes of the present disclosure, it should be specified that the term internal combustion engine is to be considered in a broad sense, comprising any type or architecture of internal combustion engine, comprising in said category eight cycle internal combustion engines, Diesel cycle engines as well as rotary engines (Wankel).

Furthermore, the type of engine is in no way related to the type of vehicle on which said engine can be mounted.

As anticipated, the present disclosure is of particular advantage for motorcycles, characterized by extremely limiting constraints in terms of dimensions, weight and aesthetics, but can also be applied to cars, industrial vehicles and motorised vehicles in general.

The term motorcycle is taken to mean a motorcycle having at least two wheels, i.e. a front wheel and a rear wheel. Such definition thus encompasses motorcycles having three wheels, of which for example two paired, steering wheels on the forecarriage and one drive wheel, on the rear axle, but also motorcycles which comprise a single steering wheel on the forecarriage and two drive wheels on the rear axle. Lastly, such definition of motorcycle also comprises so-called quad bikes having two wheels on the forecarriage and two wheels on the rear axle.

The internal combustion engine 4 comprises a crank chamber 8 which houses a crankshaft 12 connected to moving parts able to supply torque to said crankshaft 12 in the known manner.

For example, the moving parts comprise pistons 13, connected to the crankshaft 12 by means of rods 14 at connecting rod heads 15, counterweights 16 that serve to balance the reciprocating rectilinear motion of the piston masses 13 and the cranks or elbows 18 of the crankshaft 12.

The internal combustion engine 4 further comprises a lubrication circuit 20 configured to lubricate said crankshaft 12 and/or said moving parts 13,14,15,16,18 with lubricating oil with particular reference to the relative bushings of the connecting rod 14, the crankshaft 12, the camshaft (not shown) and so on.

For the purposes of the present disclosure the type, architecture or sizing of the lubrication circuit 20 which comprises a plurality of ducts fluidly connected to each other to allow the pressurised oil to be sent to all the moving or fixed parts of the internal combustion engine 4 which need to be lubricated and/or cooled by the action of said lubricating oil, is irrelevant.

The internal combustion engine 4 comprises an oil sump 24 to collect said lubricant oil.

In particular, the oil sump 24 is arranged in the lower part of the internal combustion engine 4 below the crank chamber 8, so as to constitute a collection tank of lubricating oil which is continuously circulated in the lubrication circuit 20.

For oil cooling purposes, the oil sump 24 has a closing casing 28 equipped with cooling fins 30.

Advantageously, the internal combustion engine 4 comprises a separating partition 32 which separates the crank chamber 8 from the oil sump 24.

The oil sump 24 is connected to the rest of the internal combustion engine 4 so as to form a single body. Preferably, the oil sump 24 is arranged under the crank chamber 8.

The separation between the crank chamber 8 and the oil sump 24 need not necessarily be hermetic, since the separating partition 32 may comprise one or more communication holes between the crank chamber 8 and the oil sump 24, in order to allow a small amount of oil to flow by gravity out of the crank chamber 8 to the oil sump 24 to facilitate the control of the oil level when cold. Said small amount is less than the amount of oil moved from the crank chamber 8 to the oil sump 24 by a first oil pump 36, as described below. In any case, the separating partition 32 significantly shields the direct heat irradiation from the crank chamber 8 towards the oil sump 24 and prevents the mixing of the oil with the crank chamber gases/vapours produced by the rotation of the crankshaft, as better described below.

Advantageously, the lubrication circuit 20 comprises a first oil pump 36 and a second oil pump 40.

The first oil pump 36 is fluidly connected in aspiration to the crank chamber 8 and in delivery to the oil sump 24.

The fluid connection between the first oil pump 36 and the crank chamber 8 is via a first suction duct 44, while the fluid connection between the first oil pump 36 and the oil sump 24 is via a first delivery duct 48.

The second oil pump 40 is fluidly connected in aspiration to the oil sump 24 and in delivery to the crank chamber 8 via the lubrication circuit 20, to re-introduce pressurised oil into the lubrication circuit 20 of the engine.

In particular, the fluid connection between the second oil pump 40 and the oil sump 24 is via a second suction duct 52, while the fluid connection between the second oil pump 40 and the crank chamber 8 is via a second delivery duct 56.

This specific arrangement of the crank chamber 8 and the oil sump 24 makes it possible to reduce the height of the oil sump 24 and consequently the overall vertical dimensions of the engine.

Preferably, the first oil pump 36 and the second oil pump 40 are arranged in series with each other.

Preferably said first and second oil pumps 36,40 are dimensioned so that the delivery flow rate P1 of the first oil pump 36 is less than the delivery flow rate P2 of the second oil pump 40.

According to one embodiment, the first oil pump 36 is positioned in the vicinity of said separating partition 32 so as to have the first suction duct 44 of the oil near the bottom 60 of said separating partition 32.

Preferably, said bottom 60 is shaped so as to present a sort of oil collection well, to facilitate its collection in the crank chamber 8 and its aspiration through the first suction duct 44.

In fact, as seen, the volume of oil collected inside the crank chamber 8 is significantly lower than the volume of oil collected inside the oil sump 24. For this reason it is preferable to adopt a series of measures that facilitate the collection of this small volume of oil near the separating partition 32 and its subsequent aspiration.

To such purpose the crank chamber 8 comprises an oil scraper fin 64 shaped so as to collect the oil from the suction side of the first oil pump 36.

Figure 2:
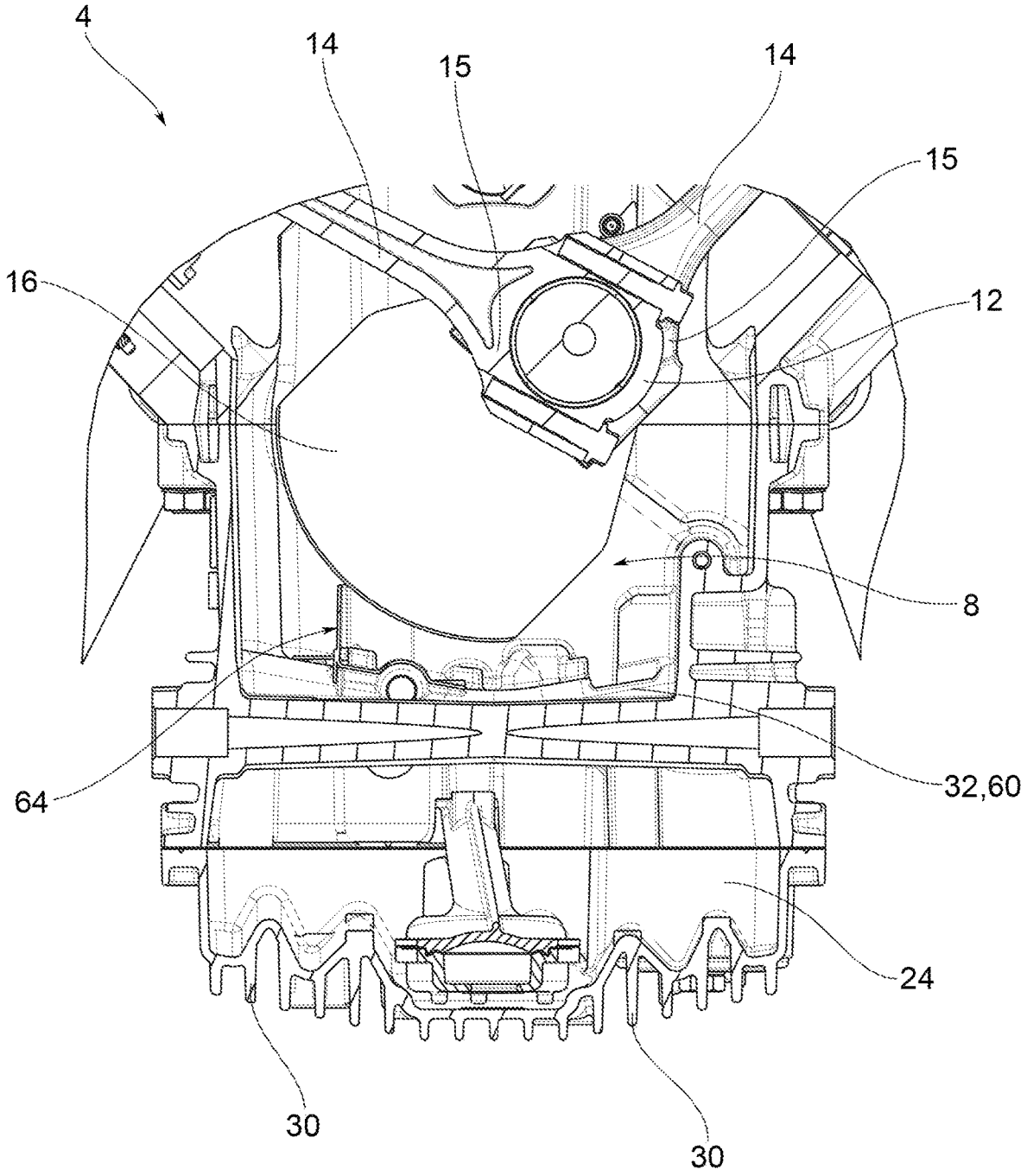
FIGS. 2, 3 and 4 are partial cross-section views, along different cross-section planes, of parts of an internal combustion engine according to one embodiment of the present disclosure.
Figure 3:
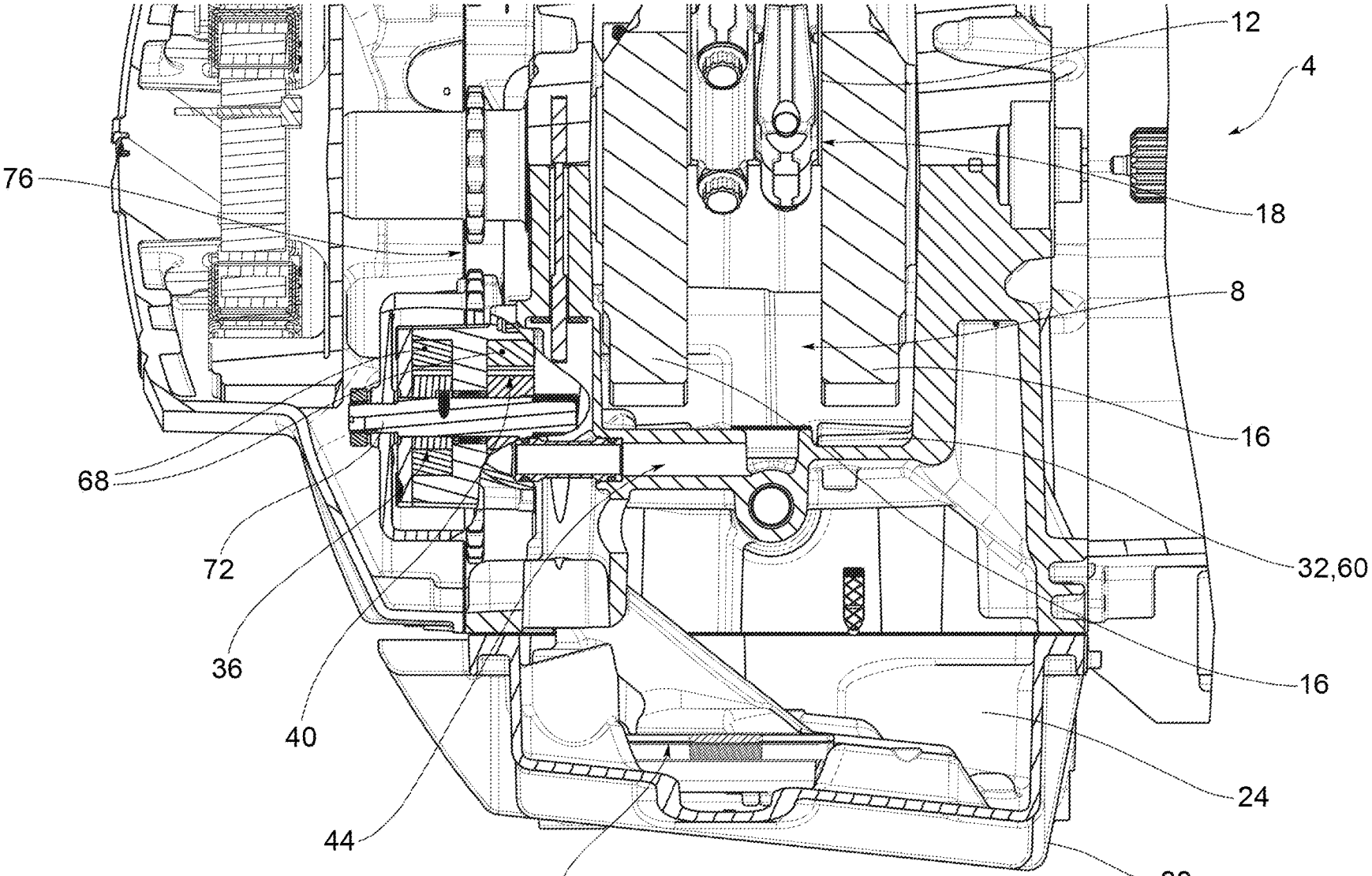
Figure 4:
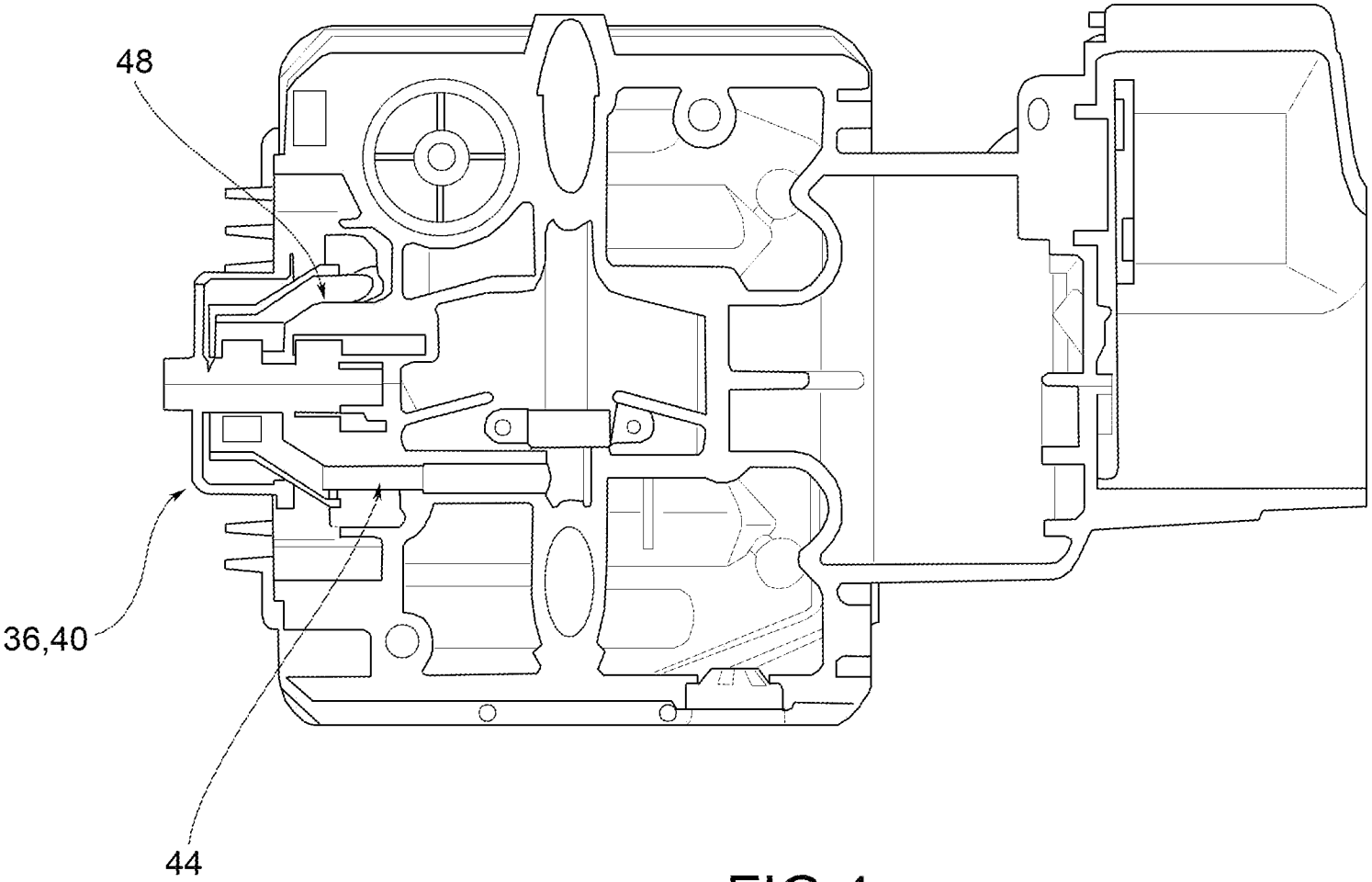
Figure 5:
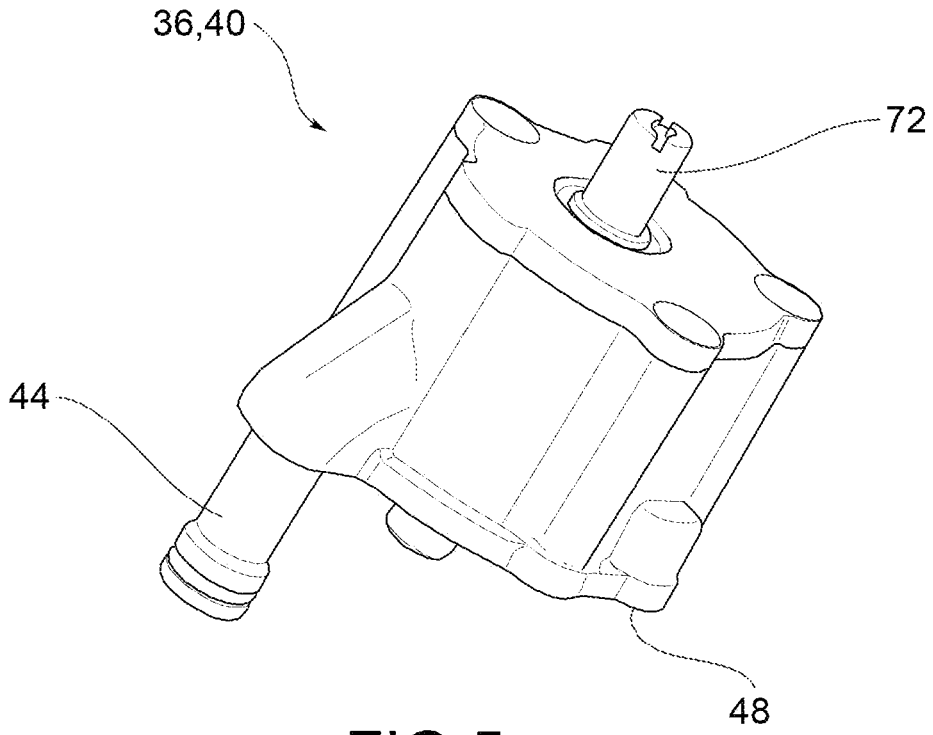
FIGS. 5 and 6 show perspective views from different angles of an oil pump according to the present disclosure.
Figure 6:
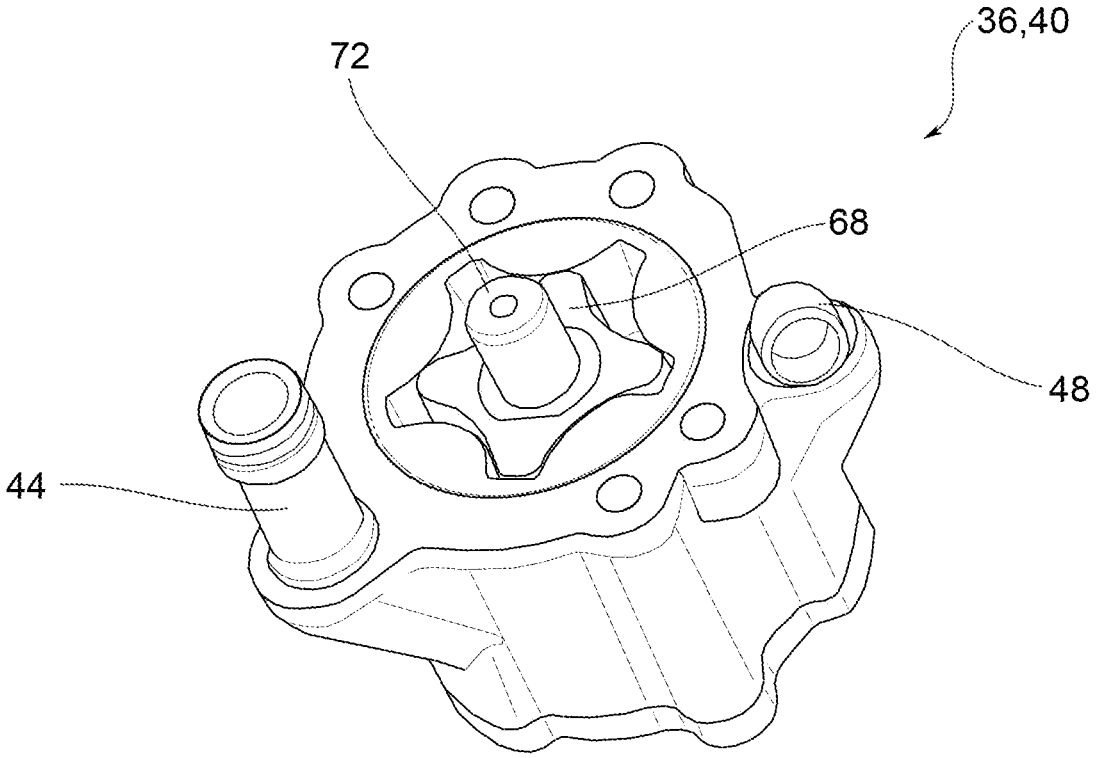
Figure 7:
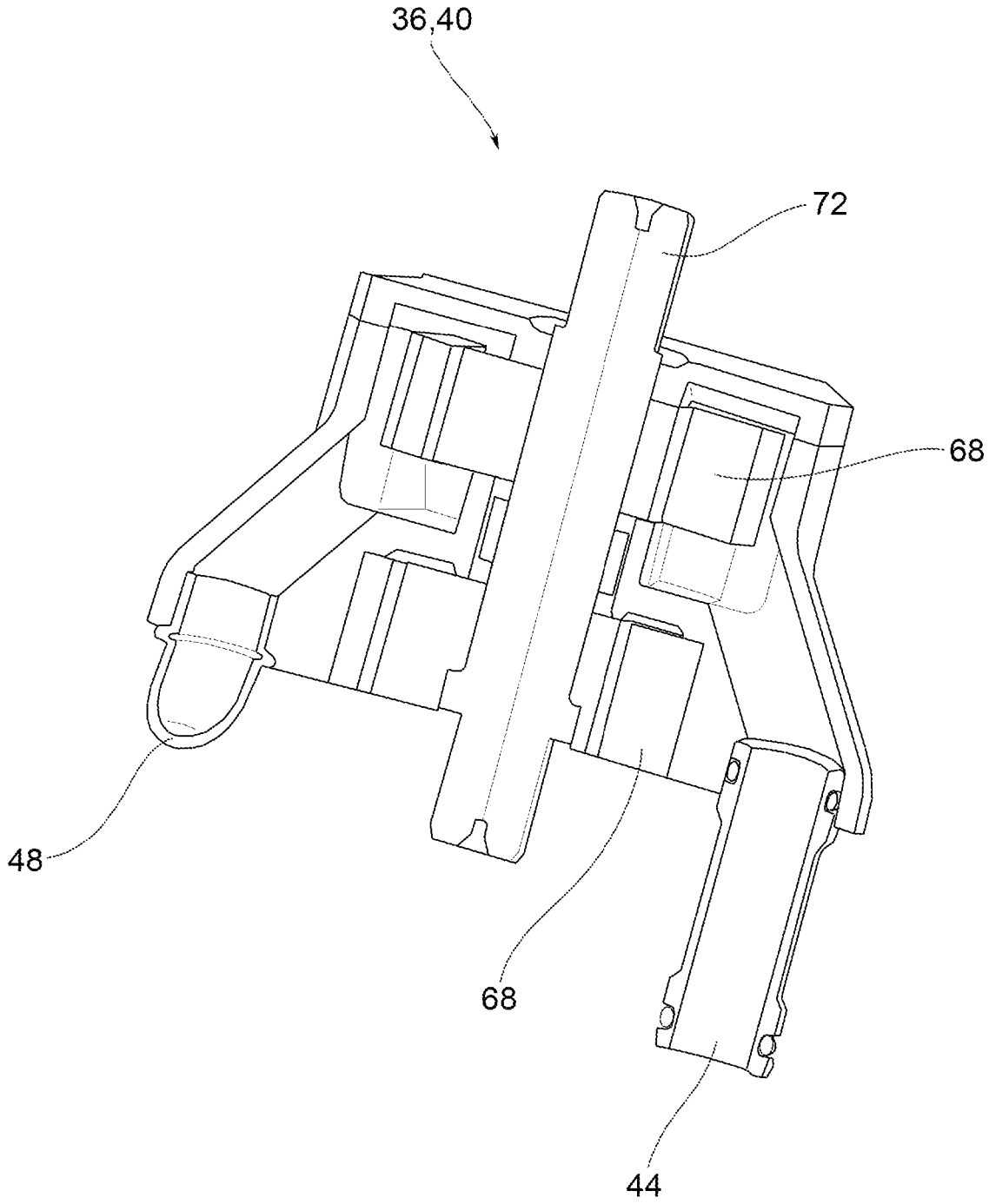
FIG. 7 shows a view, in cross-section, of the oil pump in FIGS. 5 and 6.

As can be seen, for example, in FIG. 2, the oil scraper fin 64 is substantially counter-shaped with respect to a counterweight 16 of the crankshaft 12 so as to almost skim said counterweight 16.

The purpose of the oil scraper fin 64 is to avoid the uncontrolled spillage of oil inside the crank chamber 8 and instead favour its collection on the bottom 60 of the separating partition 32 on the side of the first delivery duct 48 fluidly connected with the first oil pump 36.

As may be seen, said oil scraper fin 64 is positioned so as to create a barrier to the spreading of oil relative to the direction of rotation of the crankshaft 12 in operation.

For example, on a cross-section plane perpendicular to the crankshaft 12, the oil scraper fin 64 and the first suction duct 44 are arranged on opposite sides with respect to said crankshaft 12; furthermore, with respect to the direction of rotation of the crankshaft 12, the counterweights 16 of the crankshaft angularly sweep first the first suction duct 44 and then the oil scraper fin 64 which thereby retains the engine oil on the side of the first suction duct 44.

According to a possible embodiment, the second oil pump 40 is coaxial with said first oil pump 36 to allow the use of a single actuation motor.

Preferably, said first and/or second oil pumps 36,40 are positive displacement pumps.

For example, said first and/or second oil pumps 36,40 are lobed positive displacement pumps.

Obviously, for the purposes of the present disclosure, it is possible to use other types of oil pumps 36,40, with particular preference for positive displacement pumps.

Preferably, said first and second oil pumps 36,40 comprise vanes 68 keyed onto said drive shaft 72, operatively connected to actuating means 76.

The actuating means 76 may comprise straps, chains, simple or cascade gears and so forth, preferably connected to the crankshaft 12 so as to ensure lubrication whenever the crankshaft 12 rotates.

The functioning of the internal combustion engine according to the present disclosure will now be described.

In particular, during the operation of the internal combustion engine 4, the first oil pump 36, through the first suction duct 44, aspirates the oil collected by gravity in the crank chamber below the separating partition 32.

The engine oil, as seen, is also collected thanks to the action of the oil scraper fin 64 suitably positioned with respect to the rotation direction of the crankshaft 12 so as to facilitate the accumulation of motor oil near the first suction duct 44.

This oil is sent by the first pump 36 into the oil sump 24 and from here aspirated, by the second suction duct 52 from the second oil pump 40 which in turn sends it, via the second delivery duct 56, to the lubrication circuit 20 so as to be able to lubricate and/or cool all the fixed and/or moving parts, in a known manner.

The delivery flow rate P2 of the second oil pump 40, as seen, is greater than the delivery flow rate P1 of the first oil pump 36, since the volume of oil that is collected at the separating partition 32, in the crank chamber 8, is considerably lower than the volume of oil present in the oil sump 24.

Thanks to the fact that a very small amount of oil is collected in the crank chamber 8, such oil does not undergo mixing phenomena due to the pounding of the moving parts such as, for example, the cranks 18 or the counterweights 16 of the crankshaft 12.

Preferably the two oil pumps 36,40 are keyed onto the same drive shaft 72 so as to have a single drive and also a reduction in overall dimensions.

The oil is not pounded/mixed in the crank chamber 8 and therefore does not tend to mix with blow-by gases present in the crank chamber 8.

For this reason it is possible to pass said blow-by gases through a simple labyrinth before being re-injected on the suction side of the engine.

As may be appreciated from the description, the present disclosure makes it possible to overcome the drawbacks mentioned of the prior art.

In particular, thanks to the separation of the oil sump and the crank chamber, the oil undergoes less irradiation and less mixing and therefore less heating.

In fact, the amount of oil collected in the crank chamber and subjected to a continuous heating action, is significantly reduced compared to that of the solutions of the prior art in which all the oil falling into the oil sump is irradiated.

The oil is heated both because it receives heat from the warmer bodies and because it is mechanically stressed by the moving parts which it interferes with and lubricates. Reducing the amount of oil in the crank chamber prevents the heating by "mechanical action" of the moving parts.

Thanks to the reduced operating temperature of the oil, the latter is less stressed than in the prior solutions. As a result, for the same engine operation the oil undergoes less degradation thanks to which the relative replacement intervals are lengthened and the performance of the powertrain is increased.

From experimental tests it has been verified that at the same power and type of engine, the solution of the present disclosure allows a reduction in the oil temperature of an average of 10° C.

Moreover, thanks to the fact that the amount of oil collected in the crank chamber is significantly reduced compared to conventional solutions, the oil does not undergo mixing phenomena due to the action of the moving mechanical parts. In this case also, the oil undergoes less deterioration thanks to which the relative replacement intervals are longer and the performance of the powertrain is increased.

In addition, the substantial absence of mixing of the oil allows the elimination of centrifugal oil vapour recovery systems in favour of simpler and cheaper labyrinths, since there is a significant reduction in the amount of oil mixed with blow-by gases.

It is also possible to place the two oil pumps in a coaxial position so as to reduce the overall dimensions and even remain within the dimensions of a traditional, single oil pump solution.

Furthermore, the solution of the present disclosure makes it possible to solve the problem of oil overheating without increasing the size and dimensions of the oil sump. This aspect is particularly useful and beneficial in the motorcycle sector.

In addition, complications due to dry casing systems, as well as weight and cost increases of the prior solutions involving the use of special oil radiators, are avoided.

A person skilled in the art may make numerous modifications and variations to the engines and oil pumps described above so as to satisfy contingent and specific requirements while remaining within the sphere of protection of the disclosure as defined by the following claims.

The invention claimed is:

1. The internal combustion engine comprising:

a crank chamber which houses a crankshaft connected to moving parts able to supply torque to said crankshaft, a lubrication circuit configured to lubricate with lubricant oil said crankshaft and/or said moving parts, an oil sump to collect said lubricant oil, a separating partition which separates the crank chamber from the oil sump, wherein the lubrication circuit comprises a first oil pump and a second oil pump, wherein the first oil pump is fluidically connected in aspiration to the crank chamber and in delivery to the oil sump, the second oil pump is fluidly connected in aspiration to the oil sump and in delivery to the crank chamber by the lubrication circuit, to re-introduce the oil in the crank chamber and lubricate said moving parts, wherein the crank chamber comprises an oil scraper fin substantially counter-shaped with respect to a counterweight of the crankshaft so as to almost skim said counterweight.

2. The internal combustion engine according to claim 1, wherein said first and second oil pumps are arranged in series with each other.

3. The internal combustion engine according to claim 1, wherein said first and second oil pumps are dimensioned so that the delivery flow rate of the first oil pump is less than the delivery flow rate of the second oil pump.

4. The internal combustion engine according to claim 1, wherein the first oil pump is positioned in the vicinity of said separating partition and has a first suction duct of the oil collected on a bottom of said separating partition.

5. The internal combustion engine according to claim 1, wherein the second oil pump is coaxial with said first oil pump.

6. The internal combustion engine according to claim 1, wherein said first and/or second oil pumps are positive displacement pumps.

7. The internal combustion engine according to claim 1, wherein said first and/or second oil pumps are lobed positive displacement pumps.

8. The internal combustion engine according to claim 1, wherein said first and second oil pumps comprise vanes keyed onto said drive shaft, operatively connected to actuating means.

9. The internal combustion engine according to claim 1, wherein said oil scraper fin is positioned so as to create a barrier to the spreading of oil relative to the direction of rotation of the crankshaft in operation.

10. The internal combustion engine according to claim 1, wherein the oil sump is placed under the crank chamber.

11. The internal combustion engine according to claim 1, wherein the oil sump is connected to the rest of the internal combustion engine to form a single body.

12. A motorcycle comprising an internal combustion engine according to claim 1.

* * * * *